United States Patent [19]

Bennett

[11] 4,376,152

[45] Mar. 8, 1983

[54] CRIMPED THERMOPLASTIC FILAMENT

[76] Inventor: Robert A. Bennett, 170 Sturbridge Rd., Easton, Conn. 06425

[21] Appl. No.: 757,966

[22] Filed: Jan. 10, 1977

Related U.S. Application Data

[62] Division of Ser. No. 552,291, Feb. 24, 1975, Pat. No. 4,003,110, which is a division of Ser. No. 424,221, Dec. 13, 1973, abandoned, which is a division of Ser. No. 213,464, Dec. 29, 1971, Pat. No. 3,778,870.

[51] Int. Cl.[3] ..... D02G 3/22

[52] U.S. Cl. ..... 428/369

[58] Field of Search ..... 28/1.8, 72.15, 72.16, 28/278, 279, 280, 161, 262; 72/196; 52/659; 428/369; 24/204

[56] References Cited

U.S. PATENT DOCUMENTS

| | | | |
|---|---|---|---|
| 2,090,669 | 8/1937 | Dreyfus et al. | 28/72.15 X |
| 2,751,661 | 6/1956 | Shattuck | 28/72.15 X |
| 2,971,558 | 2/1961 | Vicknair, Jr. | 72/196 X |
| 3,119,191 | 1/1964 | Vitzthum | 24/204 UX |
| 3,568,277 | 3/1971 | Mattingly | 28/72.16 |

FOREIGN PATENT DOCUMENTS

| | | | |
|---|---|---|---|
| 653475 | 12/1962 | Canada | 28/280 |
| 46-5416 | 2/1971 | Japan | 28/161 |
| 140659 | 9/1930 | Switzerland | 28/262 |

*Primary Examiner*—Robert Mackey
*Attorney, Agent, or Firm*—F. Eugene Davis, IV

[57] ABSTRACT

A crimped thermoplastic filament which may be used in a separable hook and loop area fastener, preferably of nylon or the like, is permanently crimped into a zig-zag sawtooth configuration, by passing the same between a pair of oppositely rotating sawtooth forming rolls. The continuous filament is turned back on itself at acute angles in its zig-zag form. The cut ends of the filament present a plurality of zig-zag, hook like formations.

4 Claims, 6 Drawing Figures

FIG. 1
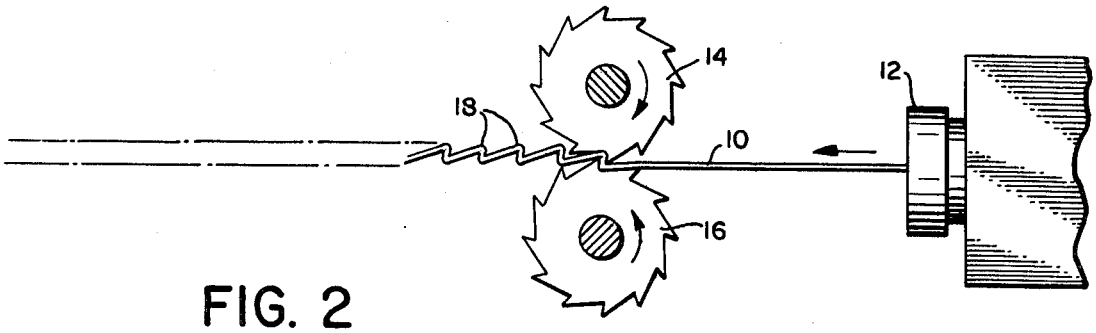
FIG. 2
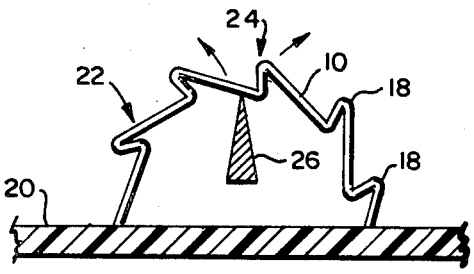
FIG. 4
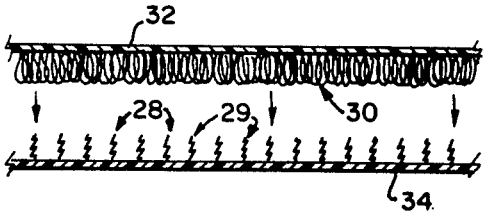
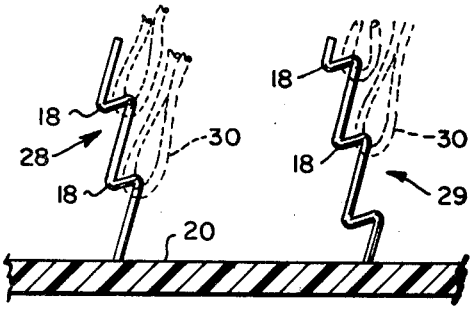
FIG. 3
FIG. 5
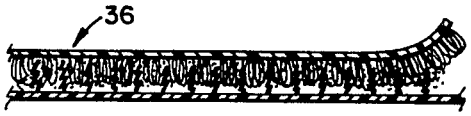
FIG. 6
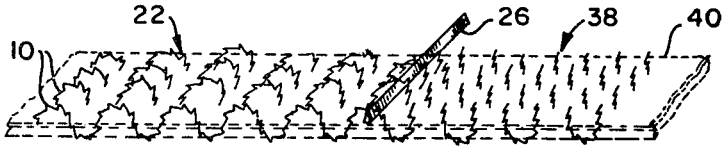

CRIMPED THERMOPLASTIC FILAMENT

This is a division of application Ser. No. 552,291, now issued as U.S. Pat. No. 4,003,110, of Jan. 18, 1977 filed Feb. 24, 1975, which was a division of application Ser. No. 424,221, filed Dec. 13, 1973, now abandoned, which application was a division of application Ser. No. 213,464, filed Dec. 29, 1971, now U.S. Pat. No. 3,778,870 granted Dec. 18. 1973.

BACKGROUND OF THE INVENTION

1. Field of the Invention

This invention relates to statistical hook and loop area fasteners. Particularly it relates to such separable fasteners of the kind currently sold in the United States under the trademark "VELCRO".

2. Prior Art

Such fasteners comprise two usually all nylon sheets or tapes, one covered with a myriad of finely woven monofilaments formed as permanent hooks, the other covered with soft nylon loops. When pressed together, they intermesh together and fasten tightly in a random or "statistical" fashion, yet they can be readily peeled apart. These prior art fasteners, which have been commercially successful, are formed by weaving a monofilament in and out of a backing sheet, producing a plurality of upstanding loops of monofilament plastic. The loops are heated to set them into their upstanding loop shape, and the hook tapes then have their loops cut "on the bias" to form an upstanding straight portion providing no function, and a hook-like portion.

SUMMARY OF THE INVENTION

According to the present invention, a nylon monofilament is crimped back on itself to provide a succession of sawtooth hook-like portions. It is then woven or otherwise fastened into the backing sheet to provide pluralities of aligned loops having a plurality of hook-like portions therein. It is then cut essentially at the top of the loop to provide two upstanding multiple-hook-bearing portions.

It is therefore an object of the invention to improve the hook portions of statistical area fasteners and to provide a zig-zag filament that may be used therein.

Another object of the invention is to provide an improved portion of an area fastener.

Still another object of the invention is to provide a hook portion of the above character providing multiple hook portions on each upstanding element.

Yet another object of the invention is to provide a method of manufacturing the hook portions of the above character.

Yet another object of the invention is to provide methods and separable fasteners of the above character which are convenient and economical to manufacture according to known processes.

Other objects of the invention will in part be obvious and will in part appear hereinafter.

The invention accordingly comprises the several steps and the relation of one or more of such steps with respect to each of the others, the apparatus embodying features of construction, combinations and arrangement of parts which are adapted to effect such steps, and the article which possesses the characteristics, properties and relation of elements, all as exemplified in the detailed disclosure hereinafter set forth, and the scope of the invention will be indicated in the claims.

THE DRAWING

For a fuller understanding of the nature and objects of the invention, references should be had to the accompanying drawing, in which:

FIG. 1 is a schematic side elevation view of apparatus according to the invention for producing a crimped monofilament hook-forming element;

FIG. 2 shows the manner in which the hook-forming element fastened to a backing sheet is cut according to the invention.

FIG. 3 shows the resulting multiple-hook-bearing upstanding elements;

FIGS. 4 and 5 illustrate the way a statistical hook and loop area fastener according to the invention may be fastened together with hooks engaging loops; and FIG. 6 illustrates the manner in which the hook-like portion may be woven into a fabric backing sheet in aligned rows for ease of multiple cutting of the aligned rows of loops.

The same reference characters refer to the same elements throughout the several views of the drawing.

SPECIFIC DESCRIPTION

Referring now to FIG. 1, a plastic monofilament 10 of nylon or the like is extruded from an extruder head 12. While it is still in its thermoplastic state, it passes through a pair or aligned, oppositely-sawtoothed, forming rolls 14 and 16, which form the filament 10 into a plurality of zigzag multiple sawtooth hook-like portions 18, facing in each direction along the filament and thus being bidirectionally exposed.

Thus the mating ratchet shaped rotating forming rolls 14 and 16 form the relatively stiff shape retaining filament into a plurality of zigzag multiple hook-like filament portions facing in both directions and intersecting at acute angles. Each look-like portion comprises a forward filament portion and a rearward filament portion and connecting return filament portion therebetween which is connected at an acute angle at each end to said forward and said rearward filament portions.

The thermoplastic filament is formed into a series of substantially parallel straight portions interconnected by substantially parallel connecting return portions at acute angles thereto at both ends, with each of the substantially parallel straight portions forming a tread portion inclined at a small acute angle to the axis of the filament and connected to each other by shorter reverse return portions forming riser portions inclined at greater acute angles to said axis, the slope of both tread portions and riser portions having the same signs, whereby the projection of each tread on said axis is greater in length than the wavelength of the filament measured between intersections of successive riser portions with the axis. A series of upper teeth 18 are formed (see FIG. 1) between a riser portion and a tread portion which meet at an acute angle. The riser portions form acute angles with a vertical plane as shown in FIG. 1. Each tread portion meets a riser portion at its other end to form an acute angle trough therebetween, with the tread portions progressing along the filament and the riser portions retrogressing along the extent of the filament.

Now referring to FIG. 2, the filament 10 is then woven or otherwise passed through a backing sheet 20 to form a plurality of looped portions 22, each having a plurality of, and preferably more than four, hook-like portions 18. The loop is then cut at its apex, as indicated at 24, by a cutting knife 26 in a manner comparable to that in which hooks are cut on the bias according to the prior art, except that the cutting is done, as previously mentioned, at the apex 24 of each upstanding loop 22. Because the filament 10 is elastic, it springs open to form upstanding hook-like portions 28 and 29 as shown in FIG. 3, each preferably bearing at least two hook-like portions 18 exposed for engagement with the multiple loops 30 of a loop sheet formed according to the prior art.

Thus, when a loop sheet 32 according to the prior art as shown in FIG. 4 is pressed down against a hook sheet, generally indicated at 34 and formed according to the invention, with the upstanding multi-hook elements 28 and 29, the loops are entangled and caught on the hook portions 18 of the hook elements 28 and 29 to form the unitary fastener 36 illustrated in FIG. 5.

Those skilled in the art will understand that one convenient method of manufacturing a hook tape 38 is illustrated in FIG. 6. There a plurality of monofilaments 10 are woven into the backing cloth tape 40 such that the loops 22 formed therein are aligned into rows so that when an elongated knife 26 is inserted therein a plurality of loops 22 may be cut to form the completed tape indicated at the right hand portion of FIG. 6. A plurality of generally parallel knives 26 with upwardly-facing cutting edges may be employed simultaneously, if desired.

Summarizing, it will be seen that I have provided multiple upstanding hook-like portions on a statistical hook area fastener, by preforming the hook filaments into a plurality of hooks, weaving or otherwise affixing the hook element into a plurality of loops on a backing sheet, and cutting the loops to provide a plurality of upstanding hook elements each having a plurality of hook portions thereon.

It will thus be seen that the objects set forth above, among those made apparent from the preceding description, are efficiently attained, and since certain changes may be made in carrying out the above process, in the described product, and in the constructions set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What I claim is:

1. An elongated thermoplastic filament bent into a series of repetitive identical zig-zags comprising substantially parallel straight filaments interconnected by substantially parallel connecting return filaments at acute angles thereto at both ends, with each of the substantially parallel straight filaments forming a tread inclined at a small acute angle to the axis of the thus formed elongated filament and connected to each other by shorter reverse return filaments forming risers inclined at greater acute angles to said axis, the slope of both treads and risers having the same sign, whereby the projection of each tread on said axis is greater in length than the wavelength of the elongated filament measured between intersections of successive risers with the axis.

2. A relatively stiff shape-retaining elongated filament of substantially uniform cross section bent into a plurality of identical zig-zag multiple hook-like filament portions facing in both directions along said elongated filament, said filament portions intersecting at acute angles and comprising elongated gently sloped tread-like lengths of filament forming a small acute angle with the neutral axis of the thus formed elongated filament and connected with each other by shorter reverse return riser-like lengths of filament inclined to the neutral axis at greater acute angles of the same sign.

3. An elongated thermoplastic filament bent along its axis into a series of repeating identical zigzags, each comprising in a direction along the filament a long running length of filament progressing generally along the direction of the elongated filament and a shorter return length of filament retrogressing generally along the direction of the elongated filament, each running length of filament meeting both adjacent return lengths of filament at acute angles.

4. An elongated thermoplastic shape-retaining filament of substantially uniform cross section and bent along its axis into a plurality of repeating identical zigzag multiple hook-like lengths of filament facing in both directions and intersecting at acute angles; each hook-like portion comprising a forward long tread-like length of filament and a rearward tread-like length of filament both progressing generally along the direction of the elongated filament and a connecting short reverse return riser-like length of filament therebetween retrogressing along the direction of the elongated filament, said riser-like length of filament connected at acute angles at each end to said forward and said rearward tread-like lengths of filament, with each of the tread-like lengths of filament being inclined at a small acute angle to the axis of the thus formed elongated filament and each of the riser-like lengths of filament being inclined at greater acute angles to said axis, the slope of both tread-like and riser-like lengths of filament having the same sign, whereby the projection of each tread-like length of filament on said axis is greater in length than the wavelength of the elongated filament measured between intersections of successive riser-like lengths of filament with the axis.

* * * * *